US005728958A

United States Patent [19]

Vater

[11] Patent Number: 5,728,958

[45] Date of Patent: Mar. 17, 1998

[54] MULTI-DOWEL DRUMSTRICK WITH PROTECTIVE SHEATH

[75] Inventor: Alan Vater, East Weymouth, Mass.

[73] Assignee: Vater Percussion, Inc., Norwood, Mass.

[21] Appl. No.: 722,974

[22] Filed: Sep. 30, 1996

[51] Int. Cl.[6] ..... G10D 13/02

[52] U.S. Cl. ..... 84/422.4

[58] Field of Search ..... 84/422.4, 422.1

[56] References Cited

U.S. PATENT DOCUMENTS

| | | | |
|---|---|---|---|
| 4,200,026 | 4/1980 | Phreaner | 84/422.4 |
| 4,320,688 | 3/1982 | Donohoe | 84/422.4 |
| 4,535,671 | 8/1985 | Stromberg et al. | 84/422.4 |
| 4,590,839 | 5/1986 | Liedtke et al. | 84/422.4 |

OTHER PUBLICATIONS

Catalog: Pro–Mark, "Forty Years of Making Sticks You Can Count On", 1996, Front Cover, Back Cover and p. 9.

Catalog: Vic Firth Inc. "The Perfect Pair", Front Cover, Back Cover, page entitled Brushes.

*Primary Examiner*—Cassandra C. Spyrou

*Attorney, Agent, or Firm*—Wolf, Greenfield & Sacks, P.C.

[57] ABSTRACT

A multi-dowel drumstick includes a bundle of dowels attached together at one end. Strips are disposed around the bundle of dowels to protect the dowels during playing. A handle is provided around the fixed end of the bundle and the strips. The dowels could be made either from wood or plastic while the strips can be made from polymer plastic. Instead of a plurality of strips being provided around the dowels, a sheath which includes the strips can be used. The sheath can be made from a single piece of material.

21 Claims, 2 Drawing Sheets

MULTI-DOWEL DRUMSTRICK WITH PROTECTIVE SHEATH

BACKGROUND OF THE INVENTION

1. Field of the Invention

The present invention relates to a multi-dowel drumstick having a protective sheath to improve durability while maintaining sound quality.

2. Description of the Related Art

The drum is one of the oldest instruments known to mankind. For thousands of years, drummers have been banging on these percussive instruments with a variety of devices. Perhaps most well known is the basic wooden drumstick as used by rock 'n roll bands and symphony orchestras alike. Over the years, as the drums themselves have changed, so has the drumstick. The drumstick is now made from different materials and comes in various shapes and sizes in order to provide different sounds. Not only have variations been made regarding the shape of the tip of the drumstick but also changes to the size and shape of the handle as well as changes in the flexibility of the drumstick as determined by the material from which it is made.

While the solid wooden drumstick is perhaps the most well known type of device used on a drum, there are variations. These include those drumsticks known as brushes. As shown in FIG. 5(*a*), a brush 500 consists of a plurality of bristles 502 which provide a sound which is softer than a solid single-piece wood drumstick. In some brushes, the spread of the bristles 502, as shown by arrow 504, can be adjusted in order to change the sound which results when the bristles 502 strike the drum surface. The brush, as shown in FIG. 5(*b*), has a narrower spread 504' than that shown in FIG. 5(*a*). The material for the bristles can include metal wire, braided heavy gauge stainless steel wires, and thick flexible plastic. The brushes do not, however, provide a very sharp or strong sound and in some musical arrangements are not appropriate.

Recently, with the increase in popularity of so-called "unplugged" concerts and recordings where the artists perform all acoustic arrangements, i.e., no amplified instruments, drummers have had to adjust accordingly. In these instances, the music requires a sound from the drums which is between a soft sound, as produced by a brash and the crisp sound, as produced by a solid wooden drumstick. In other words, the brushes produce too soft a sound and the solid wooden drumsticks produce too harsh a sound for these acoustic performances.

To address the needs of drummers in acoustic performances, there is known and used a multi-dowel drumstick as found in U.S. Pat. No. 4,535,671 issued to Stromberg, et al. (hereinafter, "the '671 patent"). The multi-dowel drumstick consists of a plurality of wooden rods which are bundled together and secured with a handle. One end of the bundle is fixed or glued together and covered by the handle while the other end of the bundle end, hence, the ends of the wooden rods, are used to strike the drum surface. The sound provided by the plurality of wooden rods striking the drum surface is more substantial than the brushes as described above and yet is softer than that of a single wooden drumstick. This type of multi-dowel drumstick, as described in the '671 patent, fixes the amount by which the free ends of the dowels can spread by using a piece of heat shrinkable material around the bundle of dowels, between the handle and the free end, in a band-like manner to hold the bundle together.

Others in the industry, e.g., Vic Firth, Inc. of Dedham, Mass., provide a multi-dowel drumstick which includes an adjustable band to adjust the amount of spread of the free ends of the wooden rods.

Multi-dowel drumsticks, as indicated above, are used in performances that require relatively strong drum beats although not as strong a percussive sound as that provided by a solid wood drumstick. These multi-dowel drumsticks, however, are still struck against the surface of the drum, cymbal or other percussion instrument with a large striking force. As a result of this, it is possible that the wooden dowels of multi-dowel drumsticks can fracture, causing pieces of wood to break off. This can cause a dangerous situation, since a flying piece of wood from a drummer's drumstick can be traveling at a significant rate of speed and could cause injury to either the drummer or another. As a result, multi-dowel drumsticks should be inspected prior to each use and might not last very long in the course of a worldwide tour.

SUMMARY OF THE INVENTION

The multi-dowel drumstick of the present invention includes a sheath disposed around the dowels to protect the dowels from damage during use. In one embodiment, the sheath comprises strips made from an impact resistant polymer which add to the tonal qualities of the multi-dowel drumstick while protecting the dowels. In addition, the present invention provides a percussive instrument in and of itself since the multi-dowel drumstick of the present invention can be used to provide sound without having to strike either a drum surface or cymbal. In other words, the multi-dowel drumstick of the present invention acts as a sound effect device similar to castanets.

One embodiment of the present invention, aimed at overcoming the drawbacks associated with known multi-dowel drumsticks, is directed to a drumstick including a plurality of substantially straight dowels disposed in a bundle parallel to one another along a longitudinal axis. Each dowel has a first dowel end and a second dowel end. In addition, a plurality of strips are disposed around the bundle of dowels. Each strip has a first strip end and a second strip end. A handle is disposed around the second strip ends of the plurality of strips and the second dowel is ends of the dowels in the bundle of dowels.

In another embodiment, a drumstick includes a single piece of material having a first end, a second end and a longitudinal axis where a plurality of split ends are disposed at the first end of the single piece, each split end substantially parallel to the longitudinal axis. A plurality of strips are disposed around the single piece of material. Each strip has a first strip end and a second strip end. A handle is wrapped around the second end of the single piece and the second strip ends of the plurality of elongated strips whereby the split ends and the first strip ends are relatively free to move.

BRIEF DESCRIPTION OF THE DRAWINGS

These and many other advantages of the present invention will be readily appreciated as the same becomes better understood by reference to the accompanying drawings, in which like reference numerals designate like or corresponding parts throughout, wherein.

DETAILED DESCRIPTION

Now, a multi-dowel drumstick having a protective sheath will be described hereinafter to with reference to the accompanying drawings.

Figure 1:
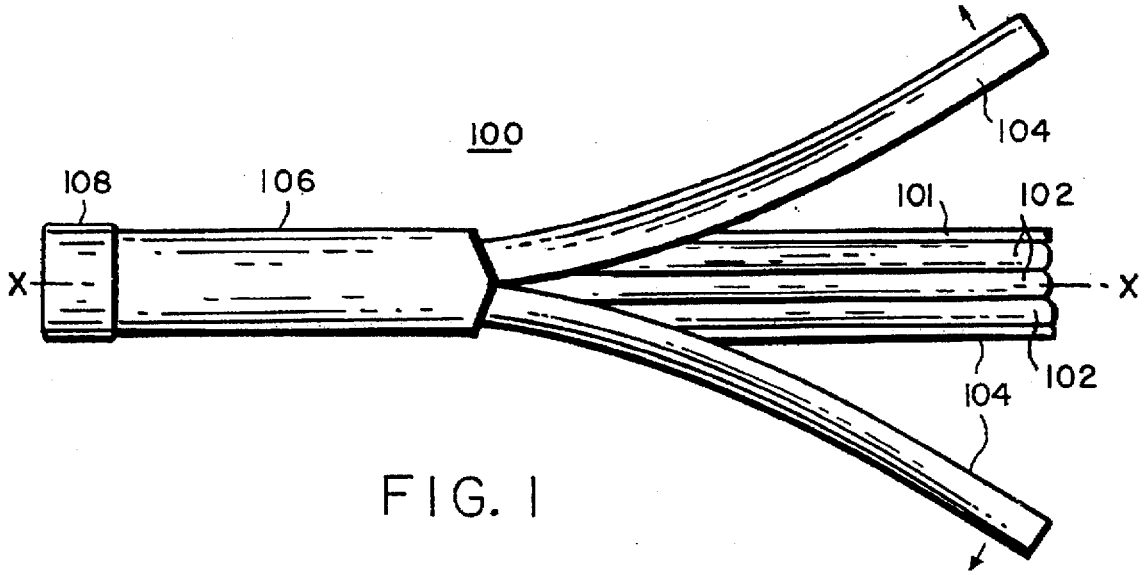
FIG. 1 is a perspective representation of the multi-dowel drumstick of the present invention.

As shown in FIG. 1, a multi-dowel drumstick 100 of the present invention includes a plurality of dowels 102 disposed in a bundle. Each dowel 102 in the bundle is substantially parallel to the other dowels along longitudinal axis X—X. A plurality of strips 104 are disposed around the bundle of dowels 102. Each dowel 102 has two ends as does each strip 104. One end of each of the dowels 102 and the strips 104 are attached together and to each other. In one embodiment, glue is used to hold these ends of the dowels 102 and the strips 104 together. Alternatively, heavy duty tape could be used to bundle them together. As shown in FIG. 1, a handle 106 is disposed around the attached ends of the dowels 102 and the strips 104. Preferably, the handle 106 is of sufficient length along the longitudinal axis of the bundle to provide a gripping surface for holding the multi-dowel drumstick 100. In a preferred embodiment, the handle 106 is made of a heat shrinkable material placed around the bundle of strips 104 and the dowels 102. An end cap 108 is provided in the preferred embodiment to provide protection to the handle end of the multi-dowel drumstick 100.

The strips 104 are preferably made from a polymer or plastic material and therefore are capable of substantially bending without breaking. As shown in FIG. 1, two of the strips 104 are shown pulled away from the bundle to reveal the dowels 102 underneath.

Figure 2:
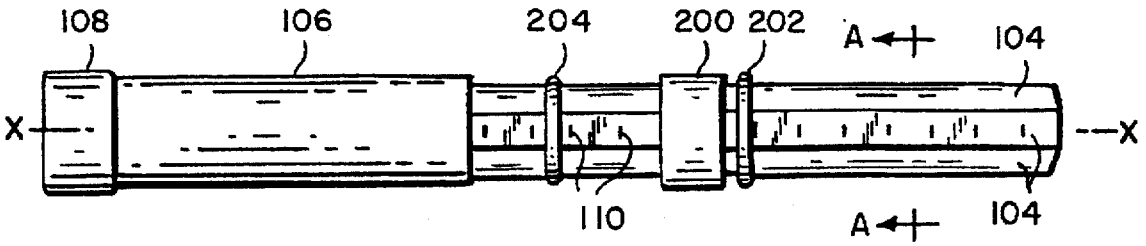
FIG. 2 is a side view of the multi-dowel drumstick of the present invention.

When the dowels 102 and the strips 104 are assembled together into the multi-dowel drumstick 100, the strips 104 will normally lie parallel to the longitudinal axis of the dowels 102. The strips combine to form a sheath around the bundle. As shown in FIG. 2, the strips 104 surround the bundle of dowels 102 which are not visible in FIG. 2. The multi-dowel drumstick 100, as shown in FIG. 2, includes a slide bar 200 movably disposed around the strips 104 and, therefore, disposed around the bundle of dowels 102. The slide bar 200 can be moved and, therefore, positioned at any point along the strip 104 between the handle 106 and the free ends of the dowels 102 and the strips 104. By adjusting the position of the slide bar 200 along the longitudinal axis of the multi-dowel drumstick, different sounds can be provided. If the slide bar 200 is positioned closer to the handle 106, the free end or playing end of the multi-dowel drumstick 100, i.e., the free ends of the strips 104 and the dowels 102, will be able to spread out and provide a softer sound when striking a drum surface. If the slide bar 200 is at or near the free ends of the dowels 102 and the strips 104, the free ends will not be able to spread out and the sound emanating from, for example, a drum struck by the multi-dowel drumstick 100, would be sharper and louder. As can be seen, a wide range of sounds can be obtained by positioning the slide bar 200 at different locations between the handle 106 and the free ends of the dowels and strips.

The slide bar 200 is preferably made from a rubber-like material with a coefficient of friction sufficient so as to keep the slide bar 200 in place along the longitudinal axis of the multi-dowel drumstick 100 during play. Since it is advantageous that the slide bar 200 remain in place during play, O-ring 202 can be provided to maintain the slide bar 200 in position. Preferably, the O-ring 202 is movably positioned between the slide bar 200 and the free end of the dowels 102 and strips 104. By placing the O-ring 202 next to the slide bar 200, the position of the slide bar 200 can be maintained during use.

A second O-ring 204 can also be provided between the slide bar 200 and the handle 106. The second O-ring 204 functions to maintain a profile of the strips 104. Specifically, when the slide bar 200 and the first O-ring 202 are at or near the playing end of the multi-dowel drumstick 100, the second O-ring 204, when placed between the slide bar 200 and the handle 106, will maintain the strips 104 against the dowels 102 and keep the strips 104, between the handle 106 and the slide bar 200, from bending outward and away from the bundle of dowels.

Since it is important to be able to duplicate a specific sound, position indicators 110 are provided along at least one of the strips 104. The position indicators could be, for example, indents in the plastic strips or numbered markers to aid in repositioning. In this way, the slide bar 200 and the first and second O-rings 202, 204 can be repeatedly placed in the same locations. Therefore, if one musical arrangement requires a first sound from the multi-dowel drumstick 100, the positions of the movable parts can be noted by the drummer for future performances so that the sound is consistent.

As can also be seen, when the slide bar 200 and the O-rings 202, 204 are either positioned closer to the handle 106 or removed entirely, the free ends of the strips 104 and the dowels 102 are less restricted in their movement. In this manner, the drumstick 100 can be used as a noise-maker by shaking it from side to side.

In one embodiment, the slide bar 200 can be permanently placed at a specific point along the strips 104 between the handle 106 and the playing end of the multi-dowel drumstick 100. In that case, the slide bar 200 could be made from adhesive tape or shrink tube material, in other words, any material which will maintain its location. Of course, with the slide bar 200 permanently placed, the first and second O-rings 202, 204 will not be necessary.

By providing the strips 104 around the bundle of dowels 102, the strips 104 will absorb the impact from the drum or percussion instrument being played. This helps to prevent breakage of the dowels and is especially important for those applications where edges of drums or cymbals are repeatedly used since the impact from such "rim shots" will be absorbed by the strips 104.

The free ends of the dowels 102 and the strips 104 are cut so as to be coplanar with one another. This plane is substantially perpendicular to the longitudinal axis X—X. In addition, various combinations of coplanarity are possible with, e.g., the dowels all parallel to one another but not parallel to the strips 104.

Figure 3:
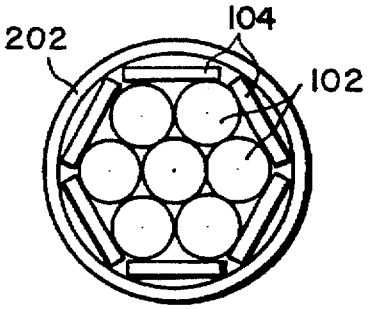
FIG. 3 is a cross-sectional view along line A—A of FIG. 1.

As shown in FIG. 3, a cross-section along line A—A of FIG. 2, the strips 104 surround the bundle of dowels 102 to form a sheath. In this manner, as above, the dowels 102 are protected from impact thereby reducing the chance that the dowels 102 would be broken. Advantageously, the sound produced by the multi-dowel drumstick 100 having the strips 104 around the bundle of s dowels 102 is enhanced.

Figure 4:
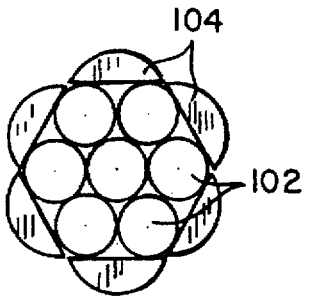
FIG. 4 is a cross-sectional view along line A—A of FIG. 1 in an alternate embodiment.
Figure 5A:
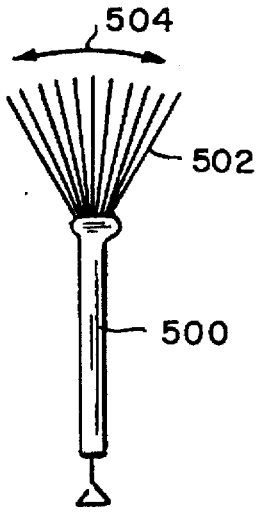
FIG. 5(a) PRIOR ART
FIGS. 5(*a*) and 5(*b*) show a brush.
Figure 5B:
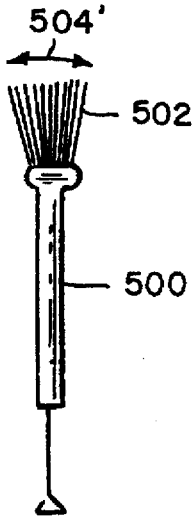
FIG.5(b) PRIOR ART

As can also be seen in FIG. 3, the strips 104 have a cross-section which is substantially rectangular while the dowels 102 have a cross-section that is substantially circular. In addition, as shown in FIG. 4, the strips 104 could, in another embodiment, have a cross-section which is substantially semicircular. A multi-dowel drumstick 100 having a configuration as shown in FIG. 4 might provide a slightly different sound or feel which in some musical arrangements might also be advantageous.

Up until this point, an embodiment of the multi-dowel drumstick of the present invention has been implemented by using a bundle of dowels 102. In an alternate embodiment, as shown in s FIG. 6, a single piece 600 of material can be provided and cut along its longitudinal axis X—X to provide a plurality of splits 602. The single piece 600 could be made from wood, plastic or carbon fiber. Effectively, the single piece 600 is divided into a plurality of splits 602 by cutting along the longitudinal axis X—X from one end toward another end. The cutting along the longitudinal axis, however, stops at a point 604 before reaching the other end. In this way, the splits 602 are separated from the single piece 600 at one end but are integral with the single piece 600 at a given point. The splits 602 can then function similar to the free ends of the wood dowels 102 as shown in FIG. 1.

Figure 6:
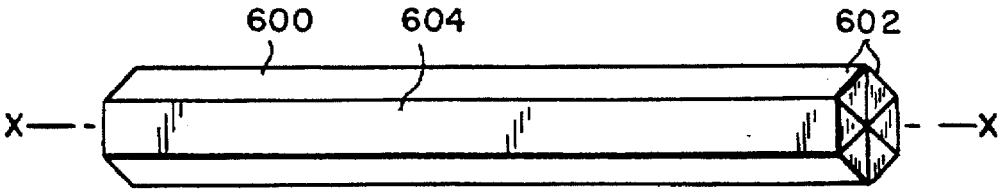
FIG. 6 is a perspective representation of a solid multi-split drumstick of the present invention.

Similar to the description of the multi-dowel drumstick of FIGS. 1–4, the handle 106 can be provided at the end of the piece 600 away from where the splits 602 have been formed. Preferably, the handle 106 will extend from the non-divided end of the piece 600 to cover the point 604 where the cut which created the splits 602 ends. The strips 104 would, of course, be placed between the handle 106 and the single piece 600 in an orientation similar to that shown in FIG. 1. It is clear that the slide bar 200 and the first and second O-rings 202, 204 can be similarly applied to the second embodiment of the present invention as shown in FIG. 6. While the single piece 600 as shown in FIG. 6 is shown to be a hexagonal piece, the single piece 600 could have any cross-section desired and the shape and number of the splits 602 would be determined by how that cross section is divided. The single piece 600 could also be a molded multi-sided piece.

Figure 7:
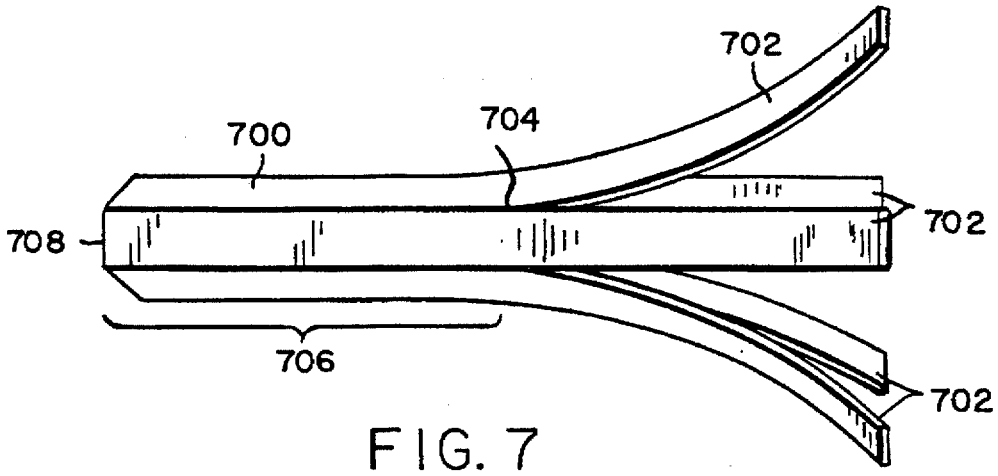
FIG. 7 is a perspective representation of a single-piece sheath.

The multi-dowel drumstick of the present invention as implemented in the embodiments previously described have used a plurality of strips 104 surrounding the bundle of dowels 102. In a still further alternate embodiment, as shown in FIG. 7, a single piece sheath 700 can be provided with a plurality of strips 702. The sheath 700 could be cylindrical, hexagonal or any shape necessary to conform to either the bundle of dowels 102 of FIG. 1 or the single piece 600 of FIG. 6. The strips 702 could be provided by cutting the sheath 700 from one end toward another but stopping at a point 704. The sheath 700 could be disposed around the bundle of dowels and that part of the sheath extending from the first end 708 to the cut stopping point 704 could be used as a handle 706. Similar to the description of the multi-dowel drumstick of FIGS. 1–4, the bundle of dowels 102 could be glued in place within the sheath 700. It is also clear that the slide bar 200 and the first and second O-rings 202, 204 can be similarly applied to this third embodiment of the present invention using the sheath 700.

The dowels 102 and the single piece 600 could be made from either plastic or wood. Preferably a hardwood such as hickory, birch, maple, ramin, oak and ash would be used. The plastic could be any impact-resistant polymer material. The strips 104 and the single-piece sheath 700, similarly, could be any impact-resistant plastic or polymer material. It is, however, not the intent to limit this disclosure to only hardwoods as the material for the dowels since other types of woods or materials may also have desirable sound qualities.

While a preferred embodiment of the invention has been described with a certain degree of particularity with reference to the drawings, alterations, modifications and variations will readily occur to those skilled in the art. Such alterations, modifications and improvements are intended to be within the scope and spirit of the invention. Accordingly, the foregoing description is by way of example only and is not intended as limiting. The invention is limited only as defined in the following claims and the equivalents thereto.

What is claimed is:

1. A drumstick, comprising:

a plurality of dowels disposed in a bundle along an axis, each dowel having a first cross-sectional shape, a first dowel end and a second dowel end; and a plurality of strips disposed circumferentially around the bundle of dowels, each strip having a second cross-sectional shape different from the first cross-sectional shape, a first strip end and a second strip end.

2. The drumstick as recited in claim 1, further comprising:

a slide bar movably disposed around the plurality of strips, the slide bar movably positionable between the first strip ends and the second strip ends.

3. The drumstick as recited in claim 2, further comprising:

a first O-ring disposed around the plurality of strips, the first O-ring movably positionable between the slide bar and the first strip ends.

4. The drumstick as recited in claim 3, further comprising:

a second O-ring disposed around the plurality of strips, the second O-ring movably positionable between the second strip ends and the slide bar.

5. The drumstick as recited in claim 2, further comprising:

means for repeatably positioning the slide bar at a same longitudinal position along the strips between the first strip ends and the second strip ends.

6. The drumstick as recited in claim 1, further comprising:

a handle disposed around the second strip ends of the plurality of strips and the second dowel ends of the dowels in the bundle of dowels.

7. The drumstick as recited in claim 6, wherein the handle comprises a heat shrinkable sleeve.

8. The drumstick as recited in claim 1, further comprising:

a slide bar disposed around the plurality of strips, the slide bar substantially permanently located at a fixed position away from the handle and the first strip ends.

9. The drumstick as recited in claim 1, wherein each strip comprises an impact resistant polymer material.

10. The drumstick as recited in claim 1, wherein each dowel comprises a hardwood.

11. The drumstick as recited in claim 1, wherein the second cross-sectional shape is substantially a rectangle.

12. The drumstick as recited in claim 1, wherein the second cross-sectional shape is substantially a half-circle.

13. The drumstick as recited in claim 1, wherein the first cross-sectional shape is substantially a circle.

14. The drumstick as recited in claim 1, wherein the first cross-sectional shape is not a circle.

15. A drumstick, comprising:

a bundle of dowels having a longitudinal axis, each dowel having a first cross-sectional shape, a first end and a second end, the bundle having a fixed end wherein the second ends of the dowels are in a fixed relation to one another and a free end where the first ends of the dowels are not in a fixed relation to one another; and a plurality of strips disposed circumferentially around the bundle of dowels, each strip having a second cross-sectional shape different from the first cross-sectional shape, a first strip end and a second strip end wherein the second strip ends of the strips are immovable relative to the fixed end of the bundle and wherein the first strip ends of the strips are movable relative to the free end of the bundle.

16. The drumstick as recited in claim 15, further comprising:

a handle disposed around the second strip ends and the fixed end of the bundle.

17. The drumstick as recited in claim 15, further comprising:

adjusting means for adjusting movability of the first strip ends relative to the free end of the bundle.

18. A drumstick, comprising:

a single piece of material having a first end, a second end and a longitudinal axis, the single piece of material including a plurality of split ends disposed at the first end of the single piece, each split end having a first cross-sectional shape; and a plurality of strips disposed circumferentially around the single piece of material, each strip having a second cross-sectional shape different from the first cross-sectional shape, a first strip end and a second strip end;

wherein the split ends and the first strip ends are relatively free to move.

19. The drumstick as recited in claim 18, further comprising:

a handle wrapped around the second end of the single piece and the second strip ends.

20. A drumstick, comprising:

a bundle of dowels, each dowel having a first cross-sectional shape; and a sheath including a plurality of strips disposed circumferentially around the bundle of dowels;

wherein each strip has a second cross-sectional shape different from the first cross-sectional shape.

21. The drumstick as recited in claim 20, wherein the strips are relatively free to move with respect to the bundle of dowels.

* * * * *